US008982210B2

(12) United States Patent
Fry et al.

(10) Patent No.: US 8,982,210 B2
(45) Date of Patent: Mar. 17, 2015

(54) VEHICLE HAVING SCANNING IMAGER WITH FIXED CAMERA AND MULTIPLE ACHROMATIC PRISM PAIRS

(75) Inventors: James A. Fry, Orlando, FL (US); William H. Barrow, Clermont, FL (US); Robert J. Murphy, Kissimmee, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 778 days.

(21) Appl. No.: 12/827,583

(22) Filed: Jun. 30, 2010

(65) Prior Publication Data

US 2012/0002049 A1 Jan. 5, 2012

(51) Int. Cl.

| | |
|---|---|
| ***H04N 7/18*** | (2006.01) |
| ***H04N 7/00*** | (2011.01) |
| ***H04N 9/07*** | (2006.01) |
| ***H04N 5/225*** | (2006.01) |
| ***F42B 15/08*** | (2006.01) |
| ***F41G 7/00*** | (2006.01) |
| ***F41G 7/22*** | (2006.01) |
| ***F42B 15/01*** | (2006.01) |

(52) U.S. Cl.

CPC ..... *F42B 15/08* (2013.01); *F41G 7/008* (2013.01); *F41G 7/2246* (2013.01); *F41G 7/2253* (2013.01); *F41G 7/2286* (2013.01); *F41G 7/2293* (2013.01); *F42B 15/01* (2013.01)

USPC ..... 348/148; 348/31; 348/36; 348/65; 348/338; 348/340

(58) Field of Classification Search

USPC ..... 348/31, 36, 65, 148, 338, 340

See application file for complete search history.

(56) References Cited

U.S. PATENT DOCUMENTS

| | | | |
|---|---|---|---|
| 1,735,108 | A | 11/1929 | Cox |
| 3,253,525 | A | 5/1966 | Merkel |
| 3,507,565 | A | 4/1970 | Alvarez et al. |
| 3,884,548 | A | 5/1975 | Linder |
| 5,249,046 | A | 9/1993 | Ulich et al. |
| 5,391,165 | A | 2/1995 | Fountain et al. |
| 5,452,030 | A | 9/1995 | Feinbloom |
| 5,526,181 | A | 6/1996 | Kunick et al. |
| 6,201,230 | B1 | 3/2001 | Crowther et al. |

(Continued)

FOREIGN PATENT DOCUMENTS

| | | |
|---|---|---|
| GB | 2414294 | 11/2005 |

*Primary Examiner* — Emmanuel L Moise
*Assistant Examiner* — Farzana Huq
(74) *Attorney, Agent, or Firm* — Terry M. Sanks, Esq.; Beusse Wolter Sanks & Maire, P.A.

(57) ABSTRACT

A vehicle including a scanning imaging system includes a vehicle body having an outer surface, a propulsion source, and an optical window secured to the outer surface of the vehicle positioned on an optical axis for transmitting electromagnetic radiation received from a portion of an area of interest to the scanning imaging system. The scanning imaging system includes a first achromatic prism pair having prisms with different materials that have different refractive properties, and a second achromatic prism pair having prisms with different materials that have different refractive properties, both positioned on the optical axis. A camera fixed in location is optically coupled to form images from the electromagnetic radiation after being bent by the achromatic prism pairs. A motor including a controller independently rotates the first and second achromatic prism pairs about the optical axis for scanning within the area of interest.

17 Claims, 8 Drawing Sheets

(56) References Cited

U.S. PATENT DOCUMENTS

| | | | | |
|---|---|---|---|---|
| 6,310,730 | B1 | 10/2001 | Knapp et al. | |
| 6,343,767 | B1 * | 2/2002 | Sparrold et al. | 244/3.16 |
| 6,344,937 | B1 | 2/2002 | Sparrold et al. | |
| 6,694,094 | B2 * | 2/2004 | Partynski et al. | 396/7 |
| 6,765,644 | B1 | 7/2004 | Anderson et al. | |
| 6,919,840 | B2 | 7/2005 | Friedrich et al. | |
| 7,037,005 | B2 | 5/2006 | Kreger et al. | |
| 2004/0057656 | A1 | 3/2004 | Chu et al. | |
| 2005/0039370 | A1 | 2/2005 | Strong | |
| 2005/0213964 | A1 * | 9/2005 | Kreger et al. | 396/544 |
| 2007/0024978 | A1 | 2/2007 | Jackson et al. | |
| 2010/0027089 | A1 | 2/2010 | Nilsson | |

* cited by examiner

Condition 1: $\beta = (n_1-1)\,\alpha_1 + (n_2-1)\,\alpha_2$

Condition 2: $\alpha_1/V_1 + \alpha_2/V_2 = 0$

Condition 3: $\alpha_1\,(dn_1/dT) + \alpha_2\,(dn_2/dT) = 0$

Condition 4: $V_2/V_1 = (dn_2/dT)/(dn_1/dT)$

VEHICLE HAVING SCANNING IMAGER WITH FIXED CAMERA AND MULTIPLE ACHROMATIC PRISM PAIRS

FIELD

Disclosed embodiments relate to scanning optical systems that include imaging devices, and more particularly to scanning optical systems that include optical arrangements comprising prisms that eliminate the need to move the imaging device to image an area of interest.

BACKGROUND

Imaging systems used for monitoring an area typically include mechanical components for moving the imaging device, such as a camera, to direct the photodetectors associated with the camera towards an area of interest. In order to search over a given field-of-regard, the optical system must either be gimbaled or have its field of view otherwise directable.

Conventional beam-steering arrangements for missiles include an optically transmissive dome and an optical arrangement behind the dome, and a gimbal that rotates the entire optical arrangement. A disadvantage of conventional gimbaled optical arrangements for certain applications is that conventional gimbaled optical arrangements need ample amounts of sway space in order to sweep through a field-of-regard and therefore can impose expensive packaging constraints on other system attributes. Other disadvantages of gimbaled optical arrangements include significant weight and cost, as well as poor performance.

For example, conventional electro-optical missile technologies employ a dome-gimbal configuration where the optical system is placed in a gimbal behind an electro-optically transmissive dome. The domes are typically rotationally symmetric, placed at the tip of the missile, are spherical or conformal in shape, and are selected with aerodynamic performance as the primary design consideration.

In some applications, it is not practical to move the lens assembly and camera. For those instances, it would be desirable for the optical system to provide pan and tilt functionality without requiring physical movement of the lens assembly and camera.

SUMMARY

Disclosed embodiments include a vehicle comprising a scanning imaging system that includes a vehicle body having an outer surface, and a propulsion source. An optical window is secured to the outer surface of the vehicle, positioned on an optical axis for transmitting or receiving electromagnetic radiation to or from a portion of an area of interest to the scanning imaging system. The scanning imaging system includes a first achromatic prism pair comprising prisms each with different materials that have different refractive properties and at least a second achromatic prism pair comprising prisms with different materials that have different refractive properties, both positioned on the optical axis.

The respective prisms in each prism pair are paired in opposite directions to eliminate color dispersion in polychromatic light. Being achromatic as used herein means there is no rainbow effect normally associated with prisms and polychromatic light and thus no measurable chromatic aberration (i.e., the line-of-sight caused by the prism does not change with wavelength across the spectral band of the optical system). As used herein, the prism pairs being "paired in opposite directions" means that for a zero net angular deviation or tilt, one prism pair directs the light rays in identical but opposite directions with respect to the other prism pair. Use of two (or more) prism pairs comprising different materials that have different refractive properties as disclosed herein thus allows the prism pairs to be achromatic prism pairs and the scanning imaging system comprising at least two prism pairs to be achromatic. The respective first and second materials for the first achromatic prism pair can be the same or different as compared to the first and second materials for the second achromatic prism pair.

As known in optics, a Risley prism is a high resolution beam-steering device comprising a pair of independently rotatable prisms that redirects a radiation beam by refraction. Risley prisms are also sometimes referred to in the art as Herschel or Crété prisms. The achromatic prism pairs disclosed herein are generally Risley prism pairs, except the respective prisms in the prism pairs are rotated together as prism pairs.

A camera fixed in location is optically coupled to form images from the electromagnetic radiation after the line-of-sight is bent by the achromatic prism pairs. As used herein, a "camera" includes one or more lenses and a light sensitive device (e.g., CCD, or photodiode array) at the focal plane. At least one motor including a controller independently rotates the first and second achromatic prism pairs about the optical axis for scanning within the area of interest. The first and second achromatic prism pairs can also be used to scan a beam that is transmitted to an area of interest (e.g., used for laser designation).

In one disclosed embodiment the vehicle can be a military vehicle, such as a missile, a bomb, a torpedo, an airplane, a helicopter, a tank, or a truck. In such embodiments, the vehicle can utilize a disclosed scanning imaging system for scanning an area of interest. The scanning imaging system can be used for a seeker for laser guided munitions, where the scanning imaging system receives light, and wherein the images provide a target seeking function for the laser guided munition (e.g., laser guided bomb, missile, torpedo, or a precision artillery munition). The vehicle can further comprise a laser, wherein the laser is part of a laser designator that directs a laser beam from the laser using an optical arrangement comprising the motor driven first and second achromatic prism pairs as disclosed herein for directing the laser beam to a selected target within the area of interest based on an identification of the target using the images. The laser designator can use the same optical arrangement and aperture that is used for imaging, or use a separate optical arrangement and aperture. In other embodiments the laser designator is off the munition. The military vehicle can also include a radar system (e.g., for long-range seeking/targeting).

In one embodiment the military vehicle comprises a missile having a head and a missile axis. As used herein, the "head" of the missile includes the tip and extends to include front ½ of the length of the missile. In this embodiment the optical window can comprise a flat optical window that is secured to the head, that in one embodiment is a monolithic window. The optical axis of the scanning imaging system is typically tilted at least 20 degrees relative to the missile axis.

In one embodiment, the achromatic prism pairs are both athermal as well. An "athermal" prism pair is defined herein as a prism pair that for a maximum uplook condition linearly deviates (i.e. displaces) a ray traced along the optical axis for the imaging system ≤0.0005 radians of line-of-sight change due to temperature, over a temperature range of 0.0 to 100° C. It is noted that 70° C. represents the approximate maximum temperature within a missile (where the prism pairs and electronics are located) for a missile travelling at supersonic speeds that is heated by air friction. This embodiment compensates for degraded scanning imaging system performance recognized by the Inventors due to refractive index changes of the prisms over temperature, which can be significant for missiles due to frictional heating at supersonic speeds (e.g., 600° F. (about 315° C.) to 800° F. (about 425° C.). As described herein, athermal prism pair performance as described herein can be realized passively by selection of appropriate material combinations.

DETAILED DESCRIPTION

Figure 1A:
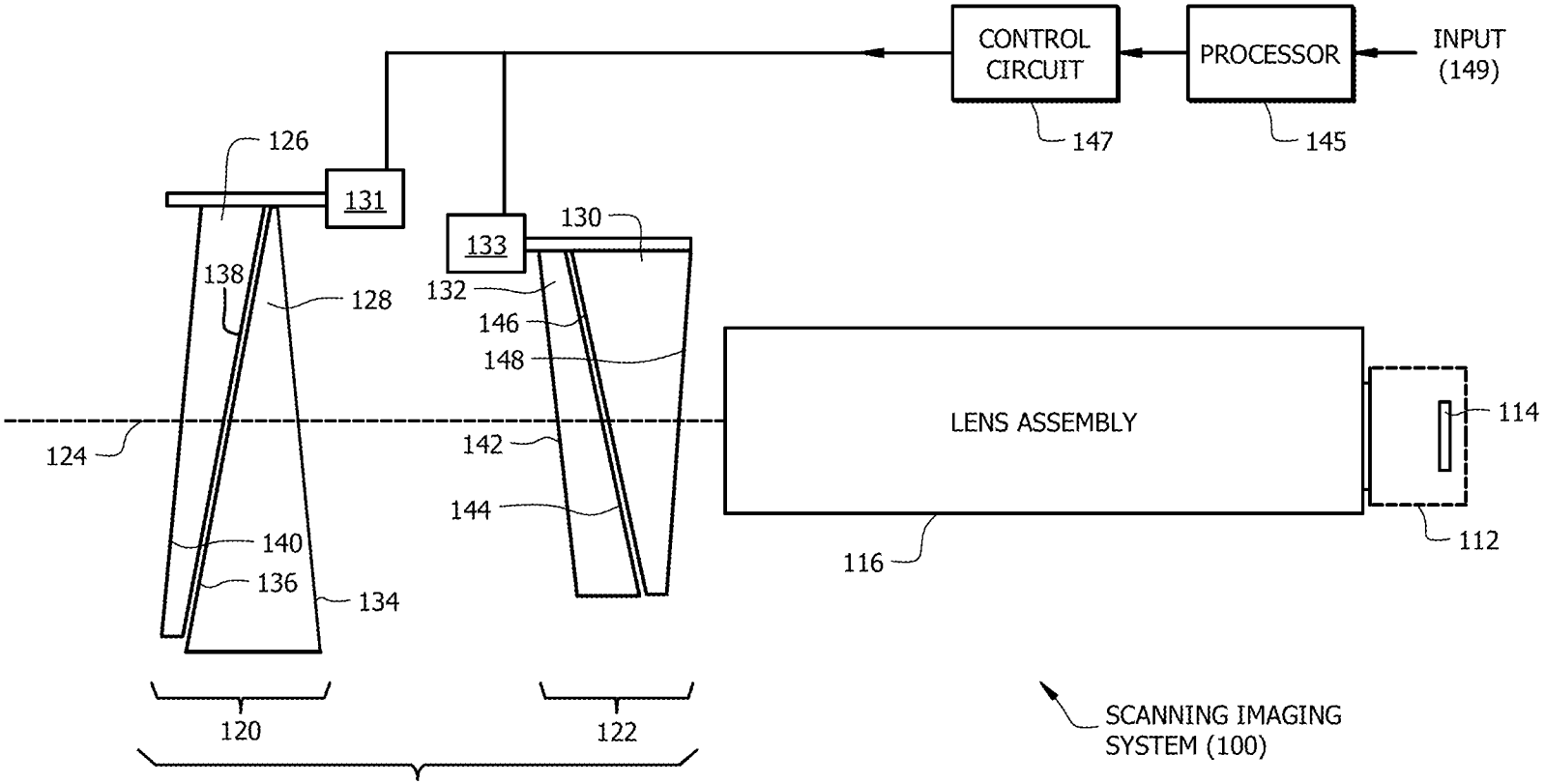
FIG. 1A is a depiction of an exemplary scanning imaging system comprising first and second achromatic prism pair and a fixed camera, according to a disclosed embodiment.

Disclosed embodiments are described with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with this Disclosure.

FIG. 1 is a depiction of an exemplary scanning imaging system 100 having a fixed lens assembly 116 and fixed imaging device 112, according to a disclosed embodiment. Imaging device 112 can be embodied as a camera that comprises an image capture element 114, for example, a charge coupled device (CCD) array or a photodiode or phototransistor array image sensor. A lens assembly 116 is mounted on, or adjacent to, the camera 112. A beam-steering optical assembly 118 is positioned in front of the lens assembly 116.

The beam-steering optical assembly 118 includes a pair of achromatic prism pairs 120 and 122 that are mounted and include motors to allow their rotation about a central optical axis 124. Prism pair 120 includes prisms 126 and 128, and prism pair 122 includes prisms 130 and 132. Motors 131 and 133 (e.g., stepper motors) are for rotating the prism pairs 120 and 122, respectively. Since the prism pairs 120 and 122 are rotatable, there is no need for a conventional gimbal to rotate the entire scanning imaging system 100 (e.g., lens assembly 116 and camera 112 can remain fixed).

The four-prism chromatically-corrected beam-steering optical assembly 118 shown in FIG. 1A can be compared to conventional two-prism Risley modules. Each set of prism wedges in a conventional Risley-prism module must be equivalent in wedge angle and optical material compensation in order to function properly. Thus, in a conventional two-prism Risley module, both wedges are made of the same material and therefore cannot correct for chromatic aberration. In contrast, in the four-prism 126, 128, 130 and 132 beam-steering optical assembly 118 shown in FIG. 1A, each prism pair 120 and 122 includes two different optical materials, and is individually achromatized over the beam-steering optical assembly's 118 designed field-of-regard.

In the first achromatic prism pair 120, prism 126 includes a first surface 134 that lies in a plane that is substantially perpendicular to the optical axis 124. A second surface 136 of the prism 126 is inclined with respect to the optical axis 124. Prism 128 includes a first surface 138 that lies in a plane that is substantially parallel to the surface 136 of prism 126. A second surface 140 of the prism 128 is inclined with respect to the optical axis 124.

In the second prism pair 122, prism 130 includes a first surface 142 that lies in a plane that is substantially perpendicular to the optical axis 124. A second surface 144 of the prism 130 is inclined with respect to the optical axis 124. Prism 132 includes a first surface 146 that lies in a plane that is substantially parallel to the surface 144 of prism 132. A second surface 148 of the prism 132 is inclined with respect to the optical axis 124. The prisms of each prism pair 120 and 122 are shown positioned adjacent to each other, but can be separated from one another.

Each achromatic prism pair 120 and 122 is rotated as a set. The prism pairs 120 and 122 having separate motors and motor controllers can be rotated independently of each other. By rotating the prism pairs 120 and 122, light (ultraviolet, visible or infrared) received from different portions of an area of interest are directed onto the image capture element 114. Thus, the direction of the field-of-view (FOV) of the camera 112 is effectively changed by rotating the prism pairs 120 and 122 without the need to move the camera 112. Rotation of the prism pairs 120 and 122 thus provides effective pan ($\theta$) and tilt ($\phi$) functionality.

The material selection for the prisms in the prism pairs 120, 122 will generally depend on, or be limited by, the wavelength band for which chromatic correction is desired and the level of chromatic correction needed. The surface tilts on the respective prisms are largely a function of the desired level of refraction (i.e. angular deviation/steering). In one embodiment, the materials for the first achromatic prism pair and second achromatic prism pair are all infrared transmissive in a wavelength band from 3 to 5 μm or 8 to 12 μm.

As described above, the prism pairs 120 and 122 and the beam-steering optical assembly 118 as a result can be both achromatic and athermal. The line-of-sight and performance (e.g., MTF, wavefront error and image quality) affected by Risley prisms is a function of the wedge angle and the refractive index. Since the index of refraction of the prism materials change with temperature, the line-of-sight and performance provided by the prism pairs 120 and 122 absent athermalization as described herein would also all significantly change with temperature. As described above, one embodiment of the invention provides simultaneous achromatic and athermal (i.e. line-of-sight and performance unaltered by changes in temperature) correction in the design of the prism pairs. Since the beam-steering optical assembly 118 comprises two (or more) pairs of prisms, each prism pair in this embodiment is independently corrected in its design to be athermal.

Scanning imaging system 100 is also shown including a processor (e.g., microprocessor or ASIC) 145 and a control circuit 147. The control circuit 147 is coupled to drive the motors 131 and 133 which as described above, independently rotate the first and second prism pairs 120 and 122 to achieve the desired pan and tilt angles. The pan and tilt angles can be set by a user via input 149 to the processor 145. In other embodiments, the output from the camera 112 is coupled to input 149, such as for target tracking in target seeking applications.

Figure 1B:
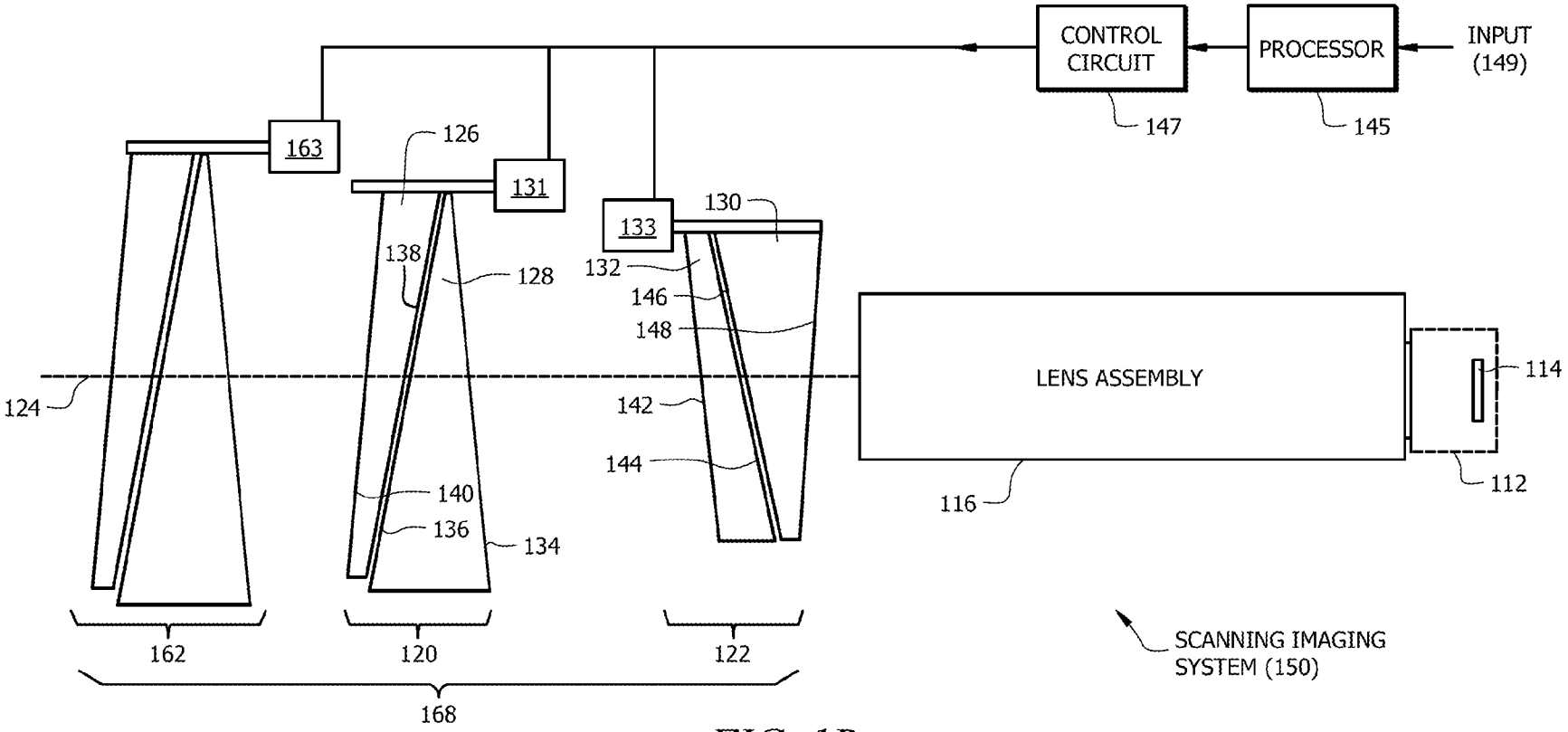
FIG. 1B is a depiction of an exemplary scanning imaging system comprising first, second and third prism pairs and a fixed camera, according to another disclosed embodiment.

FIG. 1B is a depiction of an exemplary scanning imaging system 150 comprising a six-prism chromatically-corrected beam-steering optical assembly 168 comprising first prism pair 120, second prism pair 122 and third prism pair 162, according to another disclosed embodiment. System includes the components in system 100 shown in FIG. 1A, and adds a third prism pair 162 and a third motor 163. In one embodiment, the third prism pair 162 can comprise a Jackson prism.

There are advantages for certain applications that can be obtained by including more than two prism pairs in a beam-steering optical assembly. For example, prism pairs 120 and 122 can be used for beam-steering as described above, and the third prism pair 162 can be used for correction. In one example, the third prism pair 162 can comprises a Zernike prism pair (Risley's with Zernike surfaces) that can be used for correction in a domed application where there is a dome along the optical axis of the beam-steering optical assembly, such as when the head of the missile includes a dome for aerodynamic performance that inherently functions as the outermost optical element in the beam-steering optical assembly. Disadvantages of including more than two prism pairs in the beam-steering optical assembly can include reduced optical transmittance, increased volume consumption (i.e., more space required), greater weight, and an increase in algorithmic complexity to steer three (3) prism pairs. It may also be possible to achieve advantages of scanning imaging systems having three prism pairs by having a first and second prism pair each add a third prism.

Figure 2A:
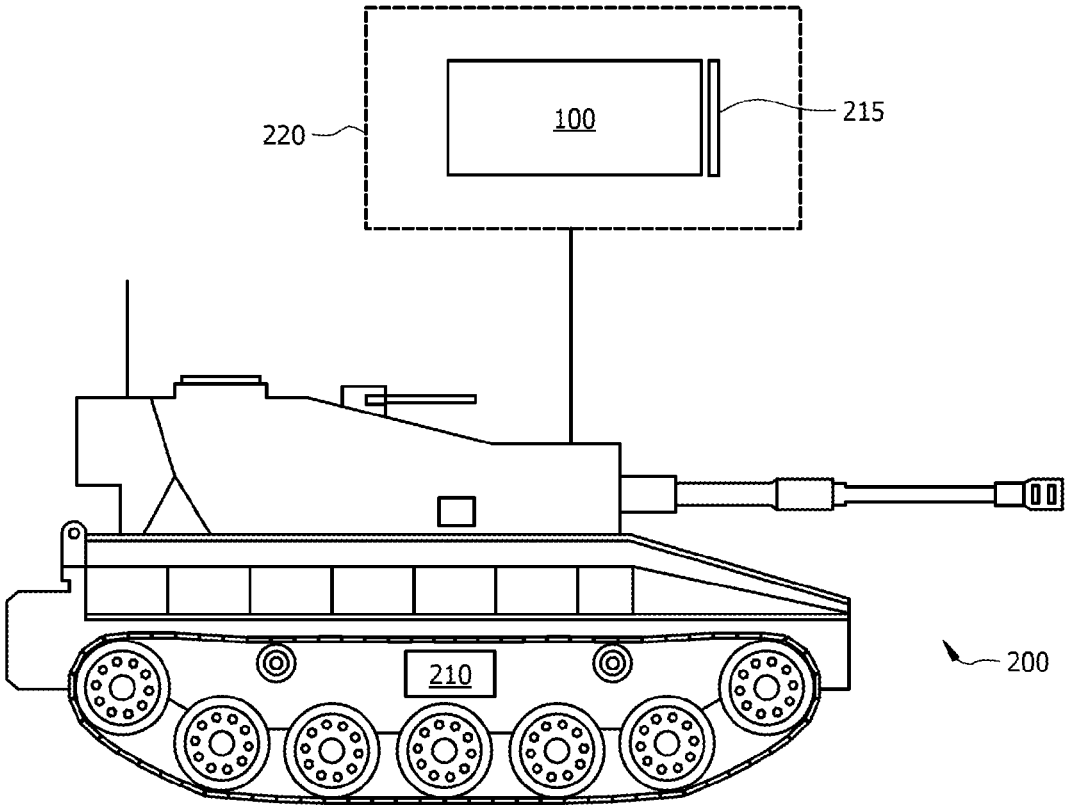
FIG. 2A is a depiction of a vehicle shown as a tank including a scanning imaging system according to a disclosed embodiment.

FIG. 2A is a depiction of a vehicle 200 shown as a tank including a scanning imaging system 220, according to a disclosed embodiment. Other exemplary vehicles that can benefit from disclosed scanning imaging systems include missiles, bombs, airplanes, helicopters, tanks, and trucks. Vehicle 200 includes a propulsion source 210, such as an engine for the tank shown.

As shown in FIG. 2A, scanning imaging system 220 comprises the components of scanning imaging system 100 shown in FIG. 1A along with a flat optical window 215. As used herein, a "flat optical window" refers to a plane-parallel plate. When the surfaces of flat optical window 215 are parallel to each other (i.e. flat), the Inventors have recognized that there is no angular deviation of light (visible, infrared, or otherwise), which is optically desirable. A flat optical window as used herein includes up to a minor amount of wedge (i.e. non-parallel surfaces) typical for the manufactured item of less than 10 arc seconds. A flat optical window 215 is unlike a conformal dome, which the Inventors have recognized can introduce severe wavefront distortions. In a typical embodiment, the flat optical window 215 is an unsegmented window to ensure that pupil-splitting effects will not be present. The optical window 215 can comprise a variety of different optically transmissive materials, such as sapphire, ALON™, or spinel.

Figure 2B:
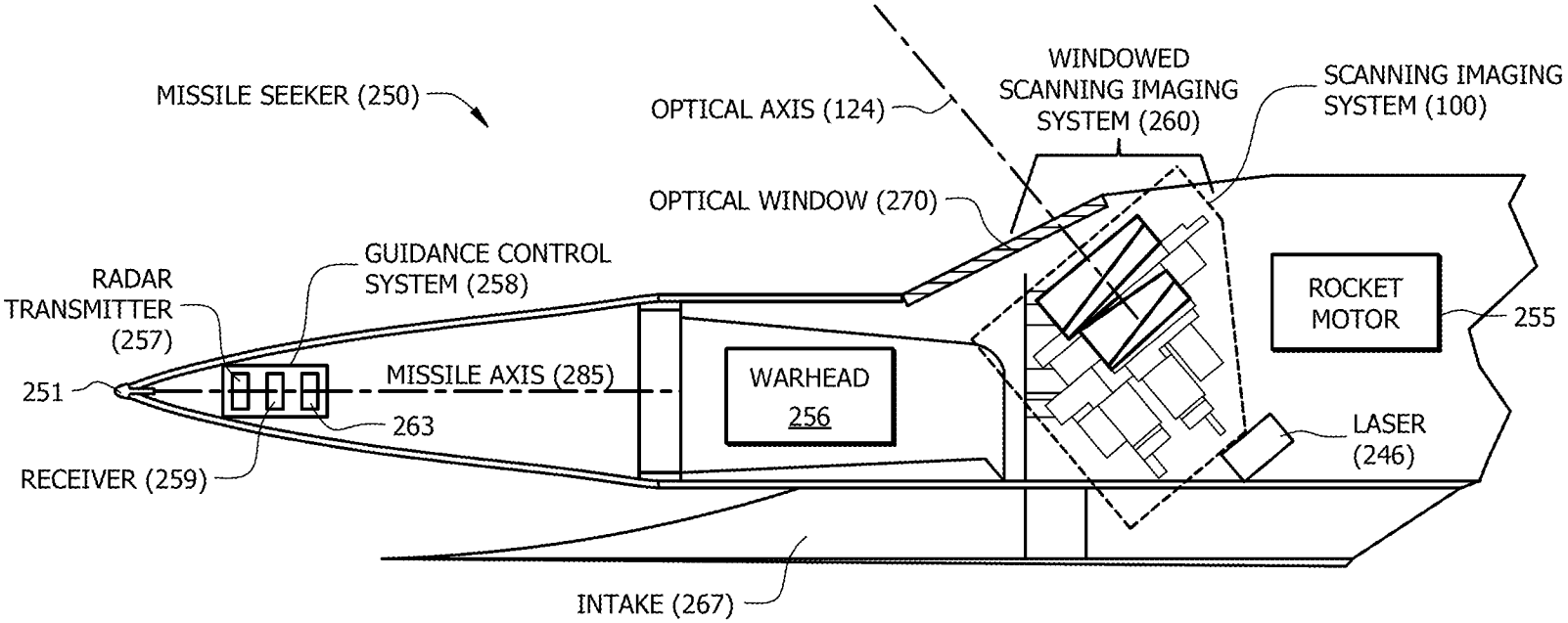
FIG. 2B is a longitudinal section depiction through the missile nose of a missile including a scanning imaging system for missile seeking, according to a disclosed embodiment.

FIG. 2B is a longitudinal section depiction through the missile nose/head 251 of a missile seeker 250 including a windowed scanning imaging system 260 for missile seeking, according to a disclosed embodiment. The missile seeker 250 shown is actually a dual missile seeker that includes an electro-optic seeker based scanning imaging system disclosed herein and a radar based seeker comprising a radar transmitting 257 and receiver 259. The radar based seeker is for long-range targeting.

The missile seeker 250 shown can be a fighter-launched supersonic missile designed to strike short, medium and long-range air-to-air and air-to-ground targets. Windowed scanning imaging system 260 provides the electro-optical seeker portion for the missile seeker 250. Windowed scanning imaging system 260 includes the scanning imaging system 100 shown in FIG. 1A together with a flat optical window 270 shown as a monolithic window that is tilted relative to the missile axis 285.

As shown in FIG. 2B, missile seeker 250 is embodied as an internal laser designator and comprises laser 246. Laser 246 is coupled to scanning imaging system 100 and laser radiation emitted can be scanned by scanning imaging system 100 over the field-of-regard provided by scanning imaging system 100 to designate a target. As known in the art, when a target is marked by a laser designator, the beam is invisible and does not shine continuously. Instead, a series of coded pulses of laser-light are fired. These signals bounce off the target (e.g., into the sky), where they are detected by the seeker, which steers itself towards the center of the reflected signal. Alternatively, laser 246 may be excluded and an external laser designator may be used with missile seeker 250.

Missile seeker 250 is shown including a propulsion source shown as a rocket motor 255, and a warhead 256. Missile seeker 250 is also shown including a guidance control system 258. Guidance control system 258 including processor 263 directs the missile seeker's 250 maneuvers and causes the maneuvers to be executed by the control section of guidance control system 258. Guidance control system 258 implements a radar-based homing guidance system. Embodied as shown as an active homing system, target illumination is supplied by a component carried in the missile 250, such as the radar transmitter 257 shown. The radar signals transmitted from the missile seeker 250 by radar transmitter 257 are reflected off the target back to the receiver 259 in the missile seeker 250. These reflected signals give the missile seeker 250 information such as the target's distance and speed. This information lets the guidance control system 258 compute the correct angle of attack to intercept the target.

The control section that receives electronic commands from the guidance control system 258 controls the missile's angle of attack. Mechanically manipulated wings (not shown), intake 267, or canard control surfaces (not shown) are mounted externally on the body of the missile seeker 250.

As known in the art, the wings, etc., are actuated by hydraulic, electric, or gas generator power, or combinations of these to alter the missile's course.

Missile seeker 250 can also be embodied as a semiactive homing system, in which the missile gets its target illumination from an external source, such as a radar transmitter carried in the launching aircraft, so that radar transmitter 257 would not be needed. The receiver 259 in the missile seeker 250 receives the radar signals reflected off the target, computes the information, and sends electronic commands to the control section. The guidance control system 258 functions in the same manner as previously discussed. Missile seeker 250 can also be embodied as a passive homing system, where the directing intelligence is received from the target. Examples of passive homing include homing on a source of infrared rays (such as the hot exhaust of jet aircraft) or radar signals (such as those transmitted by ground radar installations). Like active homing, passive homing is completely independent of the launching aircraft. The missile receiver receives signals generated by the target and then the missile control system 258 functions in the same manner as previously discussed.

The tilted flat window 270 minimizes the drag for missile seeker 250, yet still provides the capability of looking forward, sideways and up. However, as shown in FIG. 2B, the missile axis and optical axis for missile seeker 250 are shown tilted about 50 degrees, and are more generally at least 20 degrees relative to one another, with the optical axis 124 facing upward.

The tilting of the flat window 270 on the missile minimizes vignetting while maximizing the field-of-regard for the scanning imaging system 260. Embodied as a monolithic flat window prevents both window-splitting effects and dome-induced optical aberrations. Tilted flat window 270 should be of sufficient thickness to prevent bowing due to aerodynamic forces on its exterior. For certain applications for missile seeker 250, electro-optic seeker operation will be in the IR bands from 3 to 5 μm or 8 to 12 μm. Accordingly, the materials for the respective prism pairs 120 and 122 can be selected for operation from 3 to 5 μm or 8 to 12 μm.

Figure 2C:
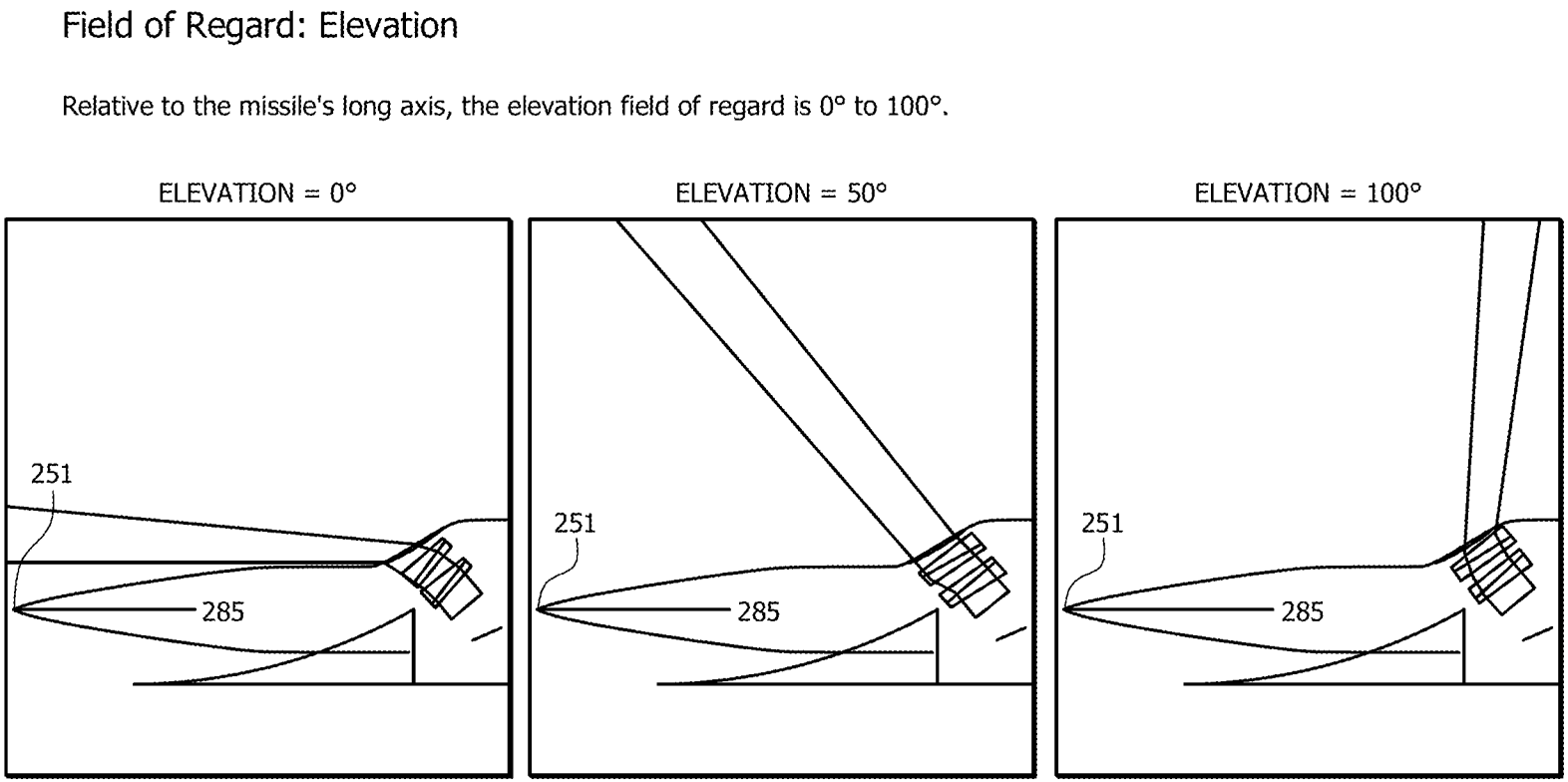
FIG. 2C is a depiction through the missile nose of a missile including a scanning imaging system for missile seeking depicted in FIG. 2B that is shown providing an elevation field-of-regard from 0° to 100°, according to a disclosed embodiment.

FIG. 2C is a depiction through the missile nose of a missile including a scanning imaging system for the missile seeker depicted in FIG. 2B that shows providing an elevation field-of-regard from 0° to 100° relative to the missile axis 285 with a fixed camera, according to a disclosed embodiment. Although not shown, the azimuthal field-of-regard provided is generally wide as well, being from. This wide field-of-regard provided by scanning imaging system 260 with a fixed camera eliminates the space required and field-of-regard limitations imposed by a conventional gimbaled optics configuration. Therefore, a significant advantage provided by missile seekers disclosed herein over conventional gimbaled missile seekers is that conventional gimbaled systems require ample amounts of sway space in order to sweep the entire optical system including the camera through a field-of-regard and therefore can impose expensive packaging constraints on other system attributes.

A significant performance improvement is also provided. When compared to conventional dome-gimbal missile configurations, disclosed missile seekers provides a wider field-of-regard and consistent aberration correction. While spherical dome-gimbal configurations can provide high-quality images, their fields of regard are comparatively limited relative to those provided by disclosed embodiments because a missile is essentially a long cylinder with a short diameter, so that the field-of-regard for a fully gimbaled system is limited by the missile's diameter and by the length of its optical system.

Missile seeker 250 provides cost reductions as compared to conventional gimbaled systems that require ample amounts of sway space in order to sweep through a field-of-regard and therefore can impose expensive packaging constraints on other system attributes. Missile seeker 250 effectively eliminates the space required and field-of-regard limitations imposed by a gimbaled optics configuration. Used in other applications, the invention could replace all gimbal components and thereby free up packaging volume.

Other performance improvements are also provided. When compared to conventional dome-gimbal missile configurations, the missile seeker provides a wider field-of-regard and consistent aberration correction. While spherical dome-gimbal configurations can provide high-quality images, their fields-of-regard are comparatively limited relative to those provided by disclosed embodiments. Similarly, with conformal dome-gimbal configurations, image quality is variable and highly aberrated as a function of field-of-regard. Disclosed embodiments also provide a reduced window size as compared to a conventional gimbaled configurations.

Although scanning imaging systems have been described above for moving applications, stationary embodiments can also benefit, such as for monitoring on a raised fixed surface, such as on a pole. Generally, disclosed scanning imaging systems can be used for one or more of monitoring, target seeking, or laser designating.

EXAMPLES

Disclosed embodiments of the invention are further illustrated by the following specific Examples, which should not be construed as limiting the scope or content of this Disclosure in any way.

Figure 3:
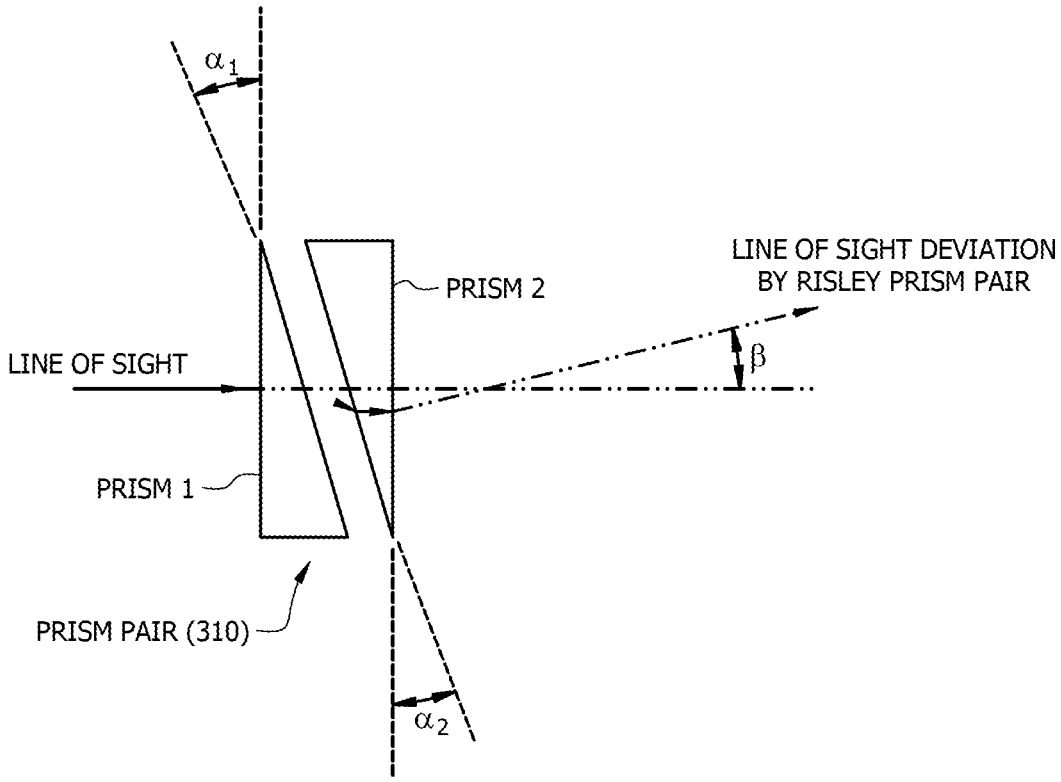
FIG. 3 shows a prism pair along with angular measures and equations for obtaining design parameters for implementing achromatic and athermal prism pairs, according to a disclosed embodiment.

As described above, disclosed scanning imaging systems can be athermal besides being achromatic by making the respective prism pairs both achromatic and athermal. Referring to FIG. 3, a prism pair 310 is shown comprising a first prism shown as prism 1 and a second prism shown as prism 2. It is well known that, for typically under 11 degrees, to achieve achromatic correction for a prism pair, conditions 1 and 2 shown below must be satisfied:

$$\beta=(n_1-1)\,\alpha_1+(n_2-1)\,\alpha_2 \qquad \text{Condition 1}$$

$$\alpha_1/V_1+\alpha_2/V_2=0 \qquad \text{Condition 2}$$

Where: β=Line-of-Sight Deviation due to the prism pair where: $n_1$=index of refraction of Prism No. 1, $n_2$=index of refraction of Prism No. 2, $\alpha_1$=wedge angle of Prism No. 1, $\alpha_2$=wedge angle of prism No. 2, $V_1$=V–number of prism No. 1 material and $V_2$=V–number of prism No. 2 material.

The Inventors have recognized that athermalization of the prism pair imposes a third constraint upon the design of the prism pair. The constraint imposed on the prism pair is as follows:

$$\alpha_1(dn_1/dT)+\alpha_2(dn_2/dT)=0 \qquad \text{Condition 3}$$

Where: $dn_1/dT$=the change in index of refraction with temperature of prism No. 1 material, and $dn_2/dT$=the change in index of refraction with temperature of prism No. 2 material.

The Inventors have also recognized that for simultaneous chromatic aberration correction and athermalization, Conditions 2 and 3 can be combined into condition 4 shown below:

$$V_2/V_1=(dn_2/dT)/(dn_1/dT) \qquad \text{Condition 4}$$

Condition 4 can be used to select optical materials such that the respective prisms can be designed such that the prism pairs are corrected for chromatic aberration and are corrected to be athermal such that the line-of-sight deviation is independent of temperature, as noted above is defined herein to be ≤0.0005 radians of line-of-sight change due to temperature, over a temperature range of 0.0 to 100° C. Condition 1 as described above can be used to establish initial wedge angles for the prisms to provide the required line-of-sight deviation. Modern optical design codes can be used to optimize the angles to provide the required line-of-sight deviation to larger angles where small angle approximations are no longer valid, typically greater than 11 degrees, such that the design is both achromatic and athermal over a broader range of angles.

One particular exemplary achromatic and athermal prism pair implementation is provided below. This embodiment uses silicon for prism No. 1 and germanium for prism No. 2 for operation in the mid-wave IR band from about 3.5 to 5.2 μms. The data for these materials is as follows:

$V_1=523$ $V_2=221$ $dn_1/dT=160\times10^{-6}/°$ C.

$dn_2/dT=400\times10^{-6}/°$ C.

Performing the analysis of Condition 4:

$$V_2/V_1=2.4\approx(dn_2/dT)/(dn_1/dT)=2.5$$

These ratios are sufficiently close that modern commercially available optical design software codes ZEMAX™, CODE V™, and Optics Software for Layout and Optimization (OSLO™) can be used to determine the wedge angles of these materials to achieve the desired line-of-sight deviation with both high levels of chromatic aberration correction and athermalization.

Figure 4:
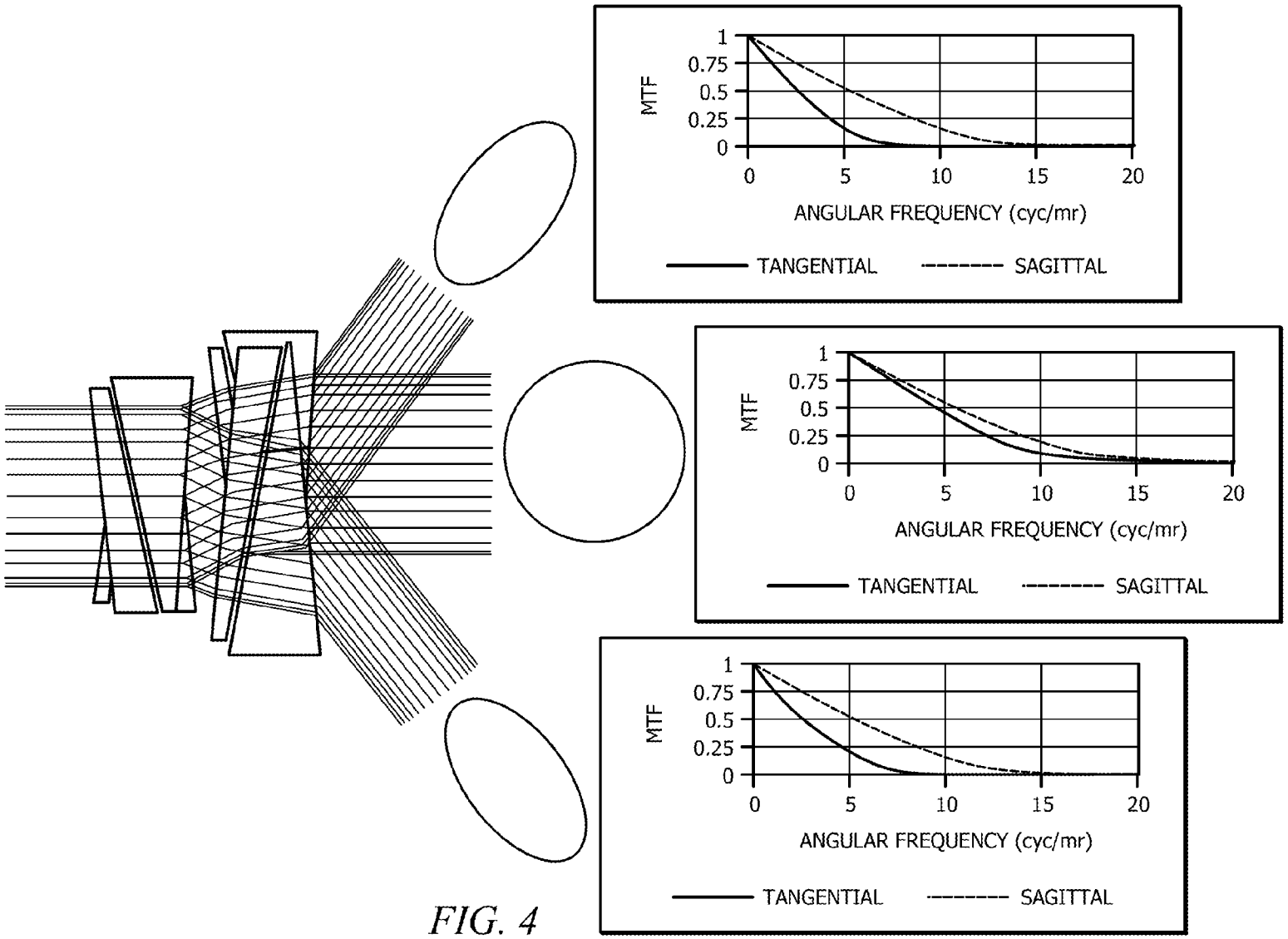
FIG. 4 provides modulation transfer function (MTF) data as a function of spatial frequency for pair of achromatic prism pairs, according to a disclosed embodiment, in a temperature range from −40° C. to 70° C.

FIG. 4 provides modulation transfer function (MTF) data as a function of spatial frequency for a pair of achromatic prism pairs, such as prism pairs 120 and 122 described above. While the chromatic aberration can be corrected with the prism pairs as described above, there is an artifact whenever the beam "looks" (or directs radiation in laser designator applications) off of the optical axis. The center beam in the FIG. 3 depiction shows the beam size and shape (spherical) for the optical system and for the prism pairs in their null (i.e. angularly non-deviating-on axis) orientation. As the scan direction look angle increases (either looking up or down), the area viewed by the optical system decreases and the beam shape becomes asymmetric, resulting in some performance degradation in the scan direction (up/down; noted as "Tangential" in the MTF plots). This effect also occurs in the azimuth direction (side-to-side; noted as "Sagittal" in the MTF plots). Thus, whenever the prism pairs are out of their null orientation, the performance will degrade to some degree. However, algorithms can alter receive imagery to improve performance in this case.

Figure 5A:
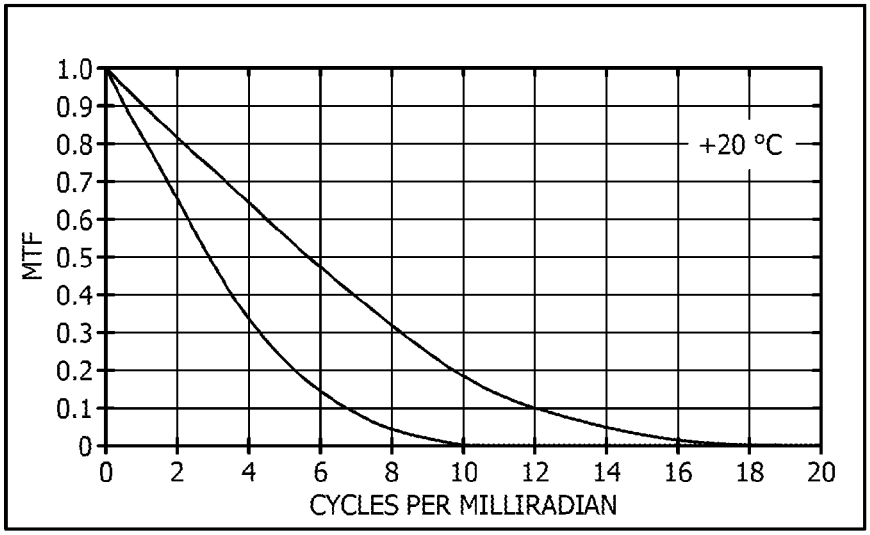
FIGS. 5A-C provide MTF data showing athermal performance for an exemplary scanning imaging system for missile seeking, according to a disclosed embodiment.
Figure 5B:
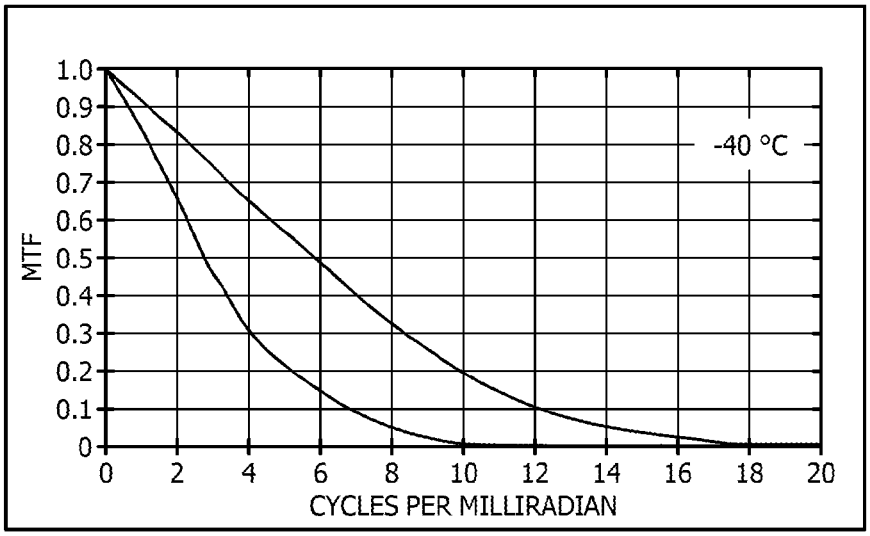
Figure 5C:
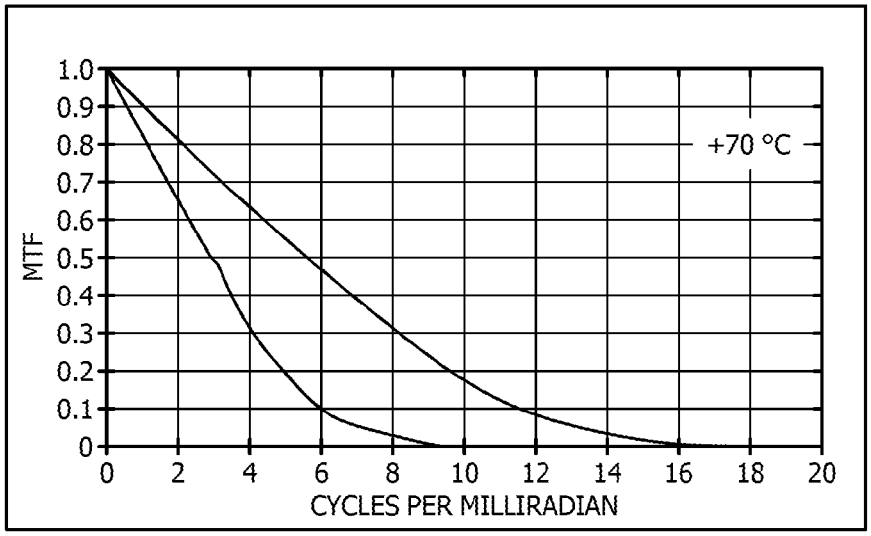

FIGS. 5A-C provide MTF data as a function of spatial frequency for pair of achromatic prism pairs, such as prism pairs 120 and 122 described above using silicon for prism No. 1 and germanium for prism No. 2 for a beam traced at the maximum elevation downlook (about 50°) with the prism pairs housed in aluminum and thermally soaked at various temperatures. The MTF (i.e. the optical performance) can be seen to not change appreciably as a function of temperature in the temperature range from −40° C. to 70° C., thus evidencing athermal performance.

While various disclosed embodiments have been described above, it should be understood that they have been presented by way of example only, and not as a limitation. Numerous changes to the disclosed embodiments can be made in accordance with the Disclosure herein without departing from the spirit or scope of this Disclosure. Thus, the breadth and scope of this Disclosure should not be limited by any of the above-described embodiments. Rather, the scope of this Disclosure should be defined in accordance with the following claims and their equivalents.

Although disclosed embodiments have been illustrated and described with respect to one or more implementations, equivalent alterations and modifications will occur to others skilled in the art upon the reading and understanding of this specification and the annexed drawings. While a particular feature may have been disclosed with respect to only one of several implementations, such a feature may be combined with one or more other features of the other implementations as may be desired and advantageous for any given or particular application.

The terminology used herein is for the purpose of describing particular embodiments only and is not intended to be limiting to this Disclosure. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this Disclosure belongs. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

We claim:

1. A vehicle including a scanning imaging system, comprising:

a vehicle body having an outer surface; a propulsion source within said vehicle body for moving said vehicle, and an optical window secured to said outer surface of said vehicle positioned on an optical axis for transmitting electromagnetic radiation received from an area of interest to said scanning imaging system, wherein said scanning imaging system comprises:

a first achromatic and athermal prism pair having prisms comprising different materials that have different refractive properties positioned on said optical axis and are athermal such that a line-of-sight deviation is independent of temperature;

a second achromatic and athermal prism pair having prisms comprising different materials that have different refractive properties positioned on said optical axis and are athermal such that a line-of-sight deviation is independent of temperature for receiving said electromagnetic radiation after bending by said first achromatic prism pair;

a camera fixed in location optically coupled to receive said electromagnetic radiation and form images from said electromagnetic radiation after said electromagnetic radiation is bent by said second achromatic and athermal prism pair, a third achromatic and athermal prism pair, that are athermal such that a line-of-sight deviation is independent of temperature, having prisms comprising different materials interposed between said second achromatic and athermal prism pair and said camera, and at least one motor including a controller for independently rotating said first and second achromatic and athermal prism pairs about said optical axis for scanning within said area of interest.

2. The vehicle of claim 1, wherein said vehicle comprises a military vehicle selected from a missile, torpedo, a bomb, an airplane, a helicopter, a tank, or a truck.

3. The vehicle of claim 2, wherein said military vehicle further comprises a laser for generating a laser beam, wherein said laser is part of a laser designator that directs said laser beam to a selected target within said area of interest using said scanning imaging system based on an identification of said target within said area of interest using said images.

4. The vehicle of claim 3, wherein said military vehicle comprises a laser guided munition, and wherein said scanning imaging system receives light originating from said laser designator, and wherein said images provide a target seeking function for said laser guided munition.

5. The vehicle of claim 1, wherein said different materials for said first achromatic and athermal prism pair and said second achromatic and athermal prism pair are all infrared transmissive in a wavelength band from 3 to 5 μm or 8 to 12 μm.

6. The vehicle of claim 1, wherein said vehicle comprises a missile seeker having a head and a missile axis, and wherein said optical window comprises a flat optical window that is secured to said head.

7. The vehicle of claim 6, wherein said optical axis is tilted at least 20 degrees relative to said missile axis.

8. The vehicle of claim 6, further comprising a radar seeker comprising a radar transmitting and receiver.

9. A missile seeker having a missile axis, wherein said missile seeker comprises:

a flat optical window secured to a head of said missile on an optical axis for transmitting electromagnetic radiation received from an area of interest to a scanning imaging system, wherein said scanning imaging system comprises:

a beam-steering optical arrangement disposed behind said optical window, said optical arrangement comprising:

a first achromatic and athermal prism pair having prisms comprising different materials that have different refractive properties positioned on an optical axis and are athermal such that a line-of-sight deviation is independent of temperature;

a second achromatic and athermal prism pair having prisms comprising different materials that have different refractive properties positioned on said optical axis and are athermal such that a line-of-sight deviation is independent of temperature;

a camera fixed in location optically coupled to receive said electromagnetic radiation and form images from said electromagnetic radiation after said electromagnetic radiation is bent by said second achromatic and athermal prism pair, a third achromatic and athermal prism pair having prisms, that are athermal such that a line-of-sight deviation is independent of temperature, and comprising different materials interposed between said second achromatic and athermal prism pair and said camera, and at least one motor for independently rotating said first and second achromatic and athermal prism pairs about said optical axis.

10. The missile seeker of claim 9, further comprising a laser for generating a laser beam, wherein said laser is part of a laser designator that directs said laser beam to a selected target within said area of interest using said scanning imaging system based on an identification of said target within said area of interest using said images.

11. The missile seeker of claim 9, wherein said different materials for said first achromatic and athermal prism pair and said second achromatic and athermal prism pair are all infrared transmissive in a wavelength band from 3 to 5 μm or 8 to 12 μm.

12. The missile seeker of claim 9, wherein said optical axis is tilted at least 20 degrees relative to said missile axis.

13. The missile seeker of claim 9, further comprising a radar seeker comprising a radar transmitting and receiver.

14. The vehicle of claim 1, wherein the optical window comprises a plane-parallel plate window wherein surfaces of the plane-parallel plate window are substantially parallel to each other to provide for a minimum angular deviation of light passing through the window.

15. The missile of claim 9, wherein the flat optical window comprises a plane-parallel plate wherein plate surfaces are substantially parallel to each other to provide for a minimum angular deviation of light passing through the window.

16. The vehicle of claim 1, wherein the line-of-sight deviation is approximately less than or equal to 0.0005 radians of line of sight change due to temperature over a range of approximately zero to 100 degrees Celsius.

17. The missile seeker of claim 9, wherein the line-of-sight deviation is approximately less than or equal to 0.0005 radians of line of sight change due to temperature over a range of approximately zero to 100 degrees Celsius.

* * * * *